US007610009B2

(12) United States Patent
Shimatsu

(10) Patent No.: US 7,610,009 B2
(45) Date of Patent: Oct. 27, 2009

(54) IMAGE RECORDING APPARATUS

(75) Inventor: Katsuya Shimatsu, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 370 days.

(21) Appl. No.: 11/484,859

(22) Filed: Jul. 12, 2006

(65) Prior Publication Data

US 2006/0275059 A1 Dec. 7, 2006

(51) Int. Cl.
*G03G 15/00* (2006.01)
*B65H 23/00* (2006.01)

(52) U.S. Cl. ..... 399/384; 399/308; 399/302; 399/303; 400/611

(58) Field of Classification Search ..... 399/316; 400/611
See application file for complete search history.

(56) References Cited

U.S. PATENT DOCUMENTS 4,990,764 A * 2/1991 Yokochi et al. ..... 250/208.1
5,506,669 A * 4/1996 Inoue et al. ..... 399/71
5,671,475 A 9/1997 De Cock et al. ..... 399/347
6,243,555 B1 6/2001 Herrick et al. ..... 399/297
6,450,382 B1 * 9/2002 Ohno ..... 226/21

FOREIGN PATENT DOCUMENTS

JP 50-34543 4/1975
JP A-2000-172090 6/2000
JP 2001-335208 4/2001
JP 2003098855 A * 4/2003
JP 2004317892 A * 11/2004
JP 2006163036 A * 6/2006

* cited by examiner

*Primary Examiner*—Judy Nguyen
*Assistant Examiner*—Allister Primo
(74) *Attorney, Agent, or Firm*—Morgan, Lewis & Bockius LLP

(57) ABSTRACT

An image recording apparatus includes: a transfer roller that transfers an image formed on a photoconductor drum onto continuous paper pressed against the photoconductor drum; and guide rollers that regulate the position of the continuous paper with respect to the photoconductor drum.

8 Claims, 7 Drawing Sheets

FIG.7A

| | TRANSFER ROLLER NIP WIDTH(W) | | |
|---|---|---|---|
| FIRST GUIDE ROLLER POSITION(L) | 1.6mm | 2.3mm | 2.8mm |
| 1mm | C | B | C |
| 2mm | A | A | C |
| 3mm | B | B | A |

FIG.7B

| | TRANSFER ROLLER NIP WIDTH(W) | | |
|---|---|---|---|
| SECOND GUIDE ROLLER POSITION(L) | 1.6mm | 2.3mm | 2.8mm |
| 1mm | A | A | B |
| 2mm | B | A | A |
| 3mm | C | B | A |

IMAGE RECORDING APPARATUS

BACKGROUND

1. Technical Field

The present invention relates to an image recording apparatus.

2. Related Art

Conventionally, the corona transfer format has been used as the transfer mechanism in high-speed continuous paper printers. However, the adoption of the transfer roller format is preferable as a measure to counter transfer defects of stepped media and transfer defects resulting from the use of coarse paper/thin paper and paper wrinkles at the time of heavy continuous printing.

The transfer roller format is a technique that is usually adopted in cut paper printers, but there are several technical issues when the transfer roller format is adopted in high-speed continuous paper printers. Important among them is the stability of contact between the paper, the photoconductor drum, and the transfer roller.

Conventionally, in printers adopting the transfer roller format (cut paper), the transfer roller causes the paper to be pressed against and contact the photoconductor drum, but when continuous paper is used rather than cut paper, tension is imparted to the continuous paper in order to convey the paper before and after transfer.

For this reason, it becomes necessary for the transfer roller to cause the paper to be pressed against and contact the drum with a pressure overcoming the tension of the paper. But with continuous paper, it becomes difficult to cause the drum and the paper to appropriately contact each other because the transfer pressure becomes extremely large, and the deformation amount of the transfer roller also becomes larger.

A width of contact between the drum and the paper can be stably obtained by disposing a guide member in order to obtain stable contact between the continuous paper and the drum and regulating the conveyance position of the continuous paper. Thus, it becomes unnecessary for the transfer roller to include the function of causing the paper to be pressed against and contact the drum, so that the function of transfer charge supply can become the main function of the transfer roller. For this reason, the selection of the material for the transfer roller becomes freed from the restrictions of physical characteristics, and the performance of transfer charge supply can be pursued, such that a higher quality image can be obtained.

Conventionally, because the transfer roller nip width and the paper contact width are substantially the same, the transfer application region becomes substantially equivalent to the nip width, but when a guide roller is used, it is necessary to set the optimum condition because the paper contact width and the transfer nip width are different.

SUMMARY

The present invention has been made in view of the above circumstances and provides an image recording apparatus whose structure is simple and whose quality is stable.

An image recording apparatus of one aspect of the invention includes: a transfer roller that transfers an image formed on a photoconductor drum onto continuous paper pressed against the photoconductor drum; and a guide roller portion that regulates the position of the continuous paper with respect to the photoconductor drum.

BRIEF DESCRIPTION OF THE DRAWINGS

Exemplary embodiments of the present invention will be described in detail based on the following figures, wherein:

FIGS. 7A and 7B are diagrams showing the relationship between guide roller positions, nip width, and image quality in the image recording apparatus pertaining to the first embodiment of the invention.

DETAILED DESCRIPTION

Figure 1:
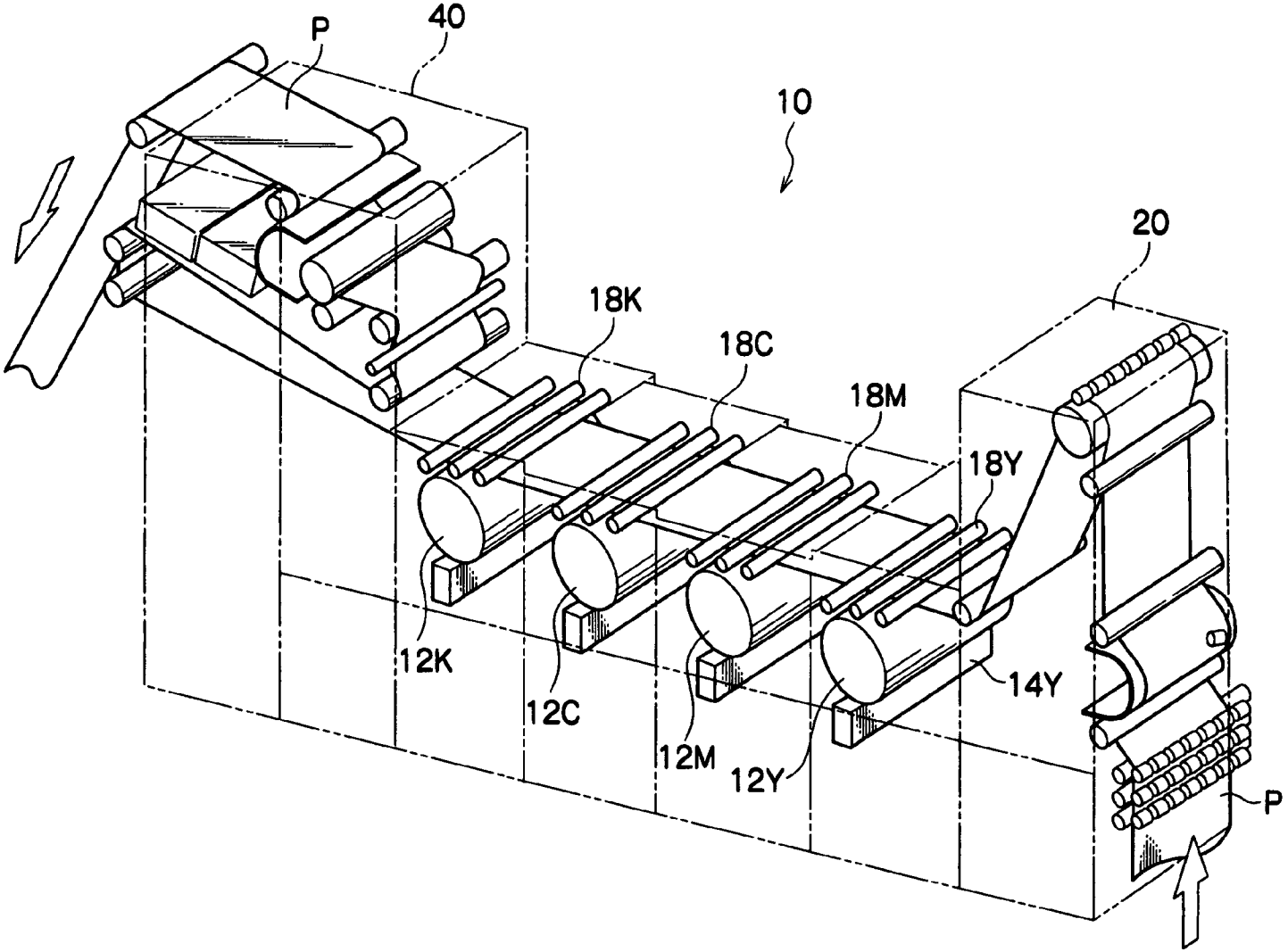
FIG. 1 is a perspective view showing an image recording apparatus pertaining to a first embodiment of the invention.
Figure 2:
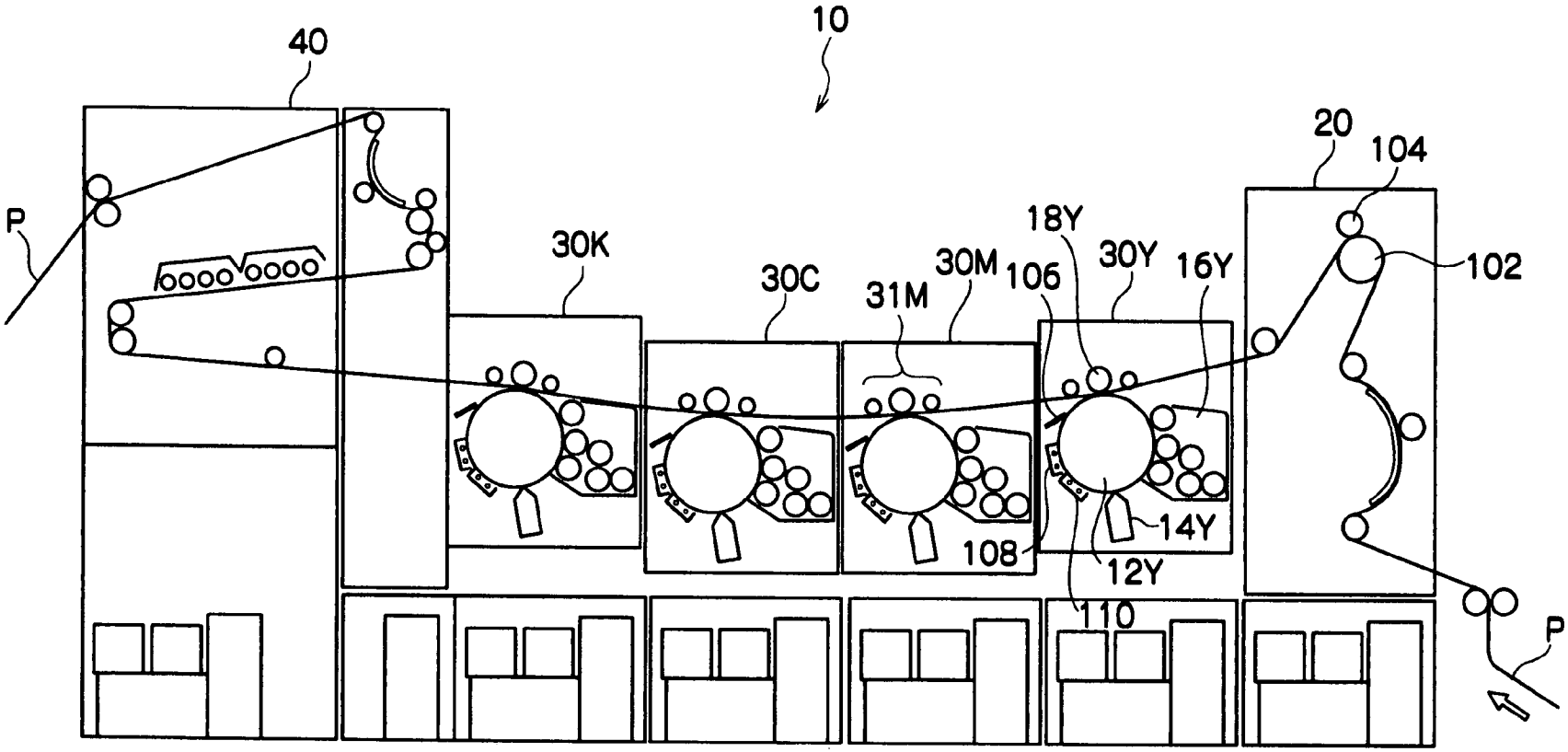
FIG. 2 is a side view showing the image recording apparatus pertaining to the first embodiment of the invention.

FIGS. 1 and 2 show an image recording apparatus pertaining to a first embodiment of the invention.

As shown in FIGS. 1 and 2, a color laser printer (referred to below simply as "printer") 10 serving as the image recording apparatus includes printing units 30Y, 30M, 30C and 30K that are disposed in order from upstream in the conveyance direction. The printing units 30Y, 30M, 30C and 30K transfer and superpose, on continuous paper P, toner images of the respective colors of yellow (Y), magenta (M), cyan (C) and black (K).

A paper conveyor unit 20 that conveys the wound continuous paper P to the printing units 30Y to 30K is disposed upstream of the printing units 30Y to 30K in the conveyance direction. A fixing unit 40 that causes the unfixed toner images transferred onto the continuous paper P by the printing units 30Y to 30K to be fixed to the continuous paper P is disposed downstream of the printing units 30Y to 30K in the conveyance direction.

The paper conveyor unit 20 is disposed with a conveyor roller 102 on which the continuous paper P is wound. An idle roller 104 contacts the conveyor roller 102, and the continuous paper P is sandwiched and conveyed between the nip portion formed by the conveyor roller 102 and the idle roller 104. Both axial-direction end portions of the conveyor roller 102 are rotatably supported on a frame of the paper conveyor unit 20 via unillustrated bearings.

Each of the printing units 30Y to 30K is disposed with a photoconductor drum 12. A transfer roller 18, a destaticizing charger 106, a cleaning device 108, a charging charger 110, an LED head 14, and a developer 16 are disposed around each of the photoconductor drums 12 in order in the rotational direction (counter-clockwise direction in the drawings) of each of the conductor drums 12.

Guide rollers 22 are disposed upstream and downstream of each of the transfer rollers 18 in the conveyance direction. Transfer units 31 are formed by the transfer rollers 18 and the guide rollers 22. The transfer rollers 18, which serve as transfer means, contact the upper surfaces of the photoconductor drums 12, nip and convey the continuous paper P supported on the guide rollers 22 together with the photoconductor drums 12, and transfer, onto the continuous paper P, the toner images formed on the photoconductor drums 12 by the developers 16.

Figure 3:
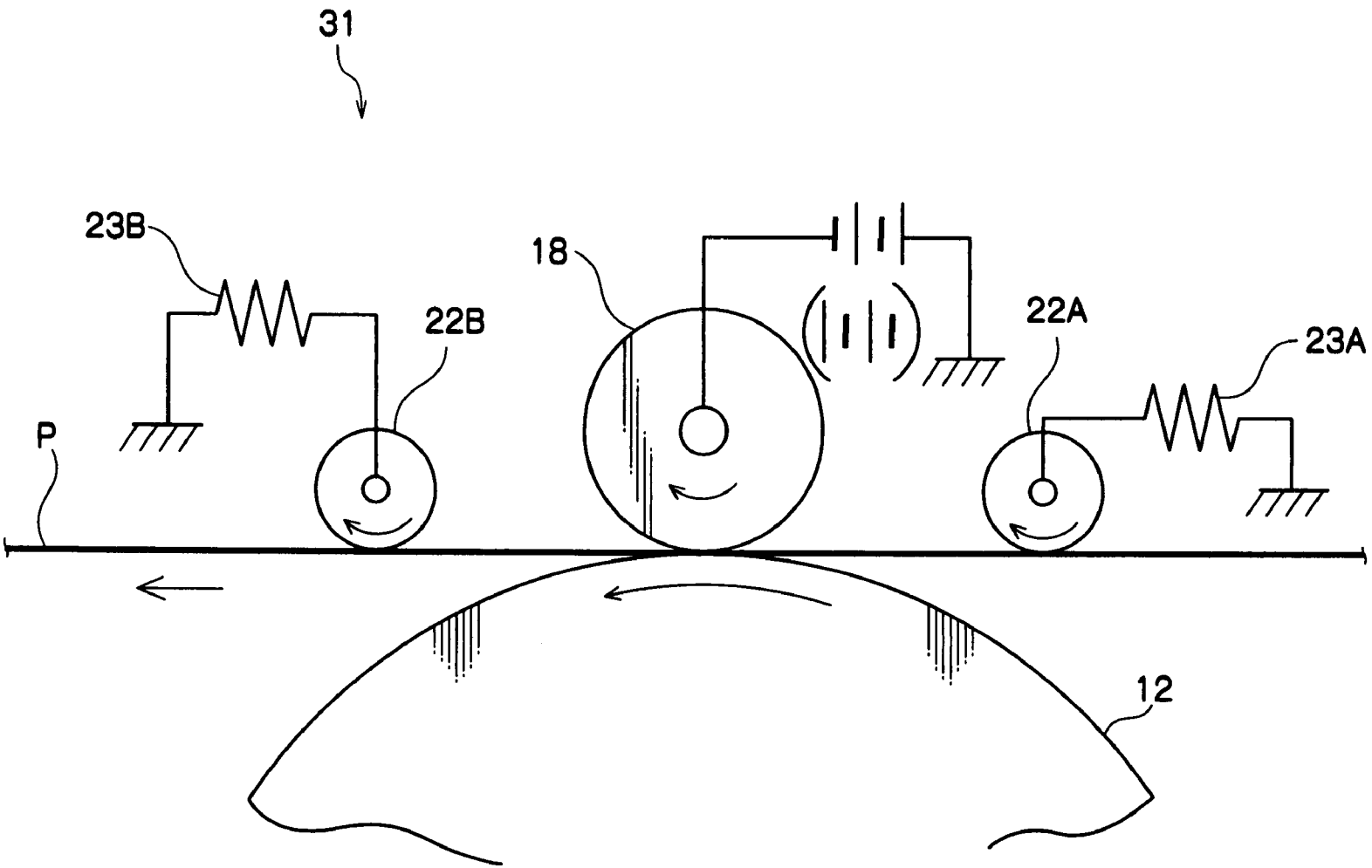
FIG. 3 is a side view showing a transfer unit of the image recording apparatus pertaining to the first embodiment of the invention.

FIG. 3 shows a transfer unit pertaining to the first embodiment of the invention.

As shown in FIG. 3, the transfer roller 18 contacts the photoconductor drum 12, causes the continuous paper P to be pressed against and contact the photoconductor drum 12, and transfers the toner image formed on the photoconductor drum 12 onto the continuous paper P.

However, because the continuous paper P is conveyed with strong tension as described above, the continuous paper P is always biased in a direction where it maintains a linear state. In order for the transfer roller 18 to press the continuous paper P against the photoconductor drum 12 counter to this tension, pressure exceeding this tension is necessary and various problems arise, such as in the mechanical strength of members supporting the transfer roller 18 and elastic deformation of the transfer roller 18 itself.

For this reason, in the present embodiment, guide rollers 22A and 22B are disposed upstream and downstream of the transfer roller 18 in the conveyance direction, and the conveyance path of the continuous paper P is regulated, whereby it can be ensured that the transfer roller 18 stably causes the continuous paper P to be pressed against and contact the photoconductor drum 12.

Further, as shown in FIG. 3, by connecting the guide rollers 22A and 22B to grounds via resistors 23A and 23B of about 100 MΩ, the potential of the continuous paper P and the toner image on the continuous paper P can be regulated.

This is to prevent a situation where the potential rises and the image is adversely affected as a result of repeatedly applying transfer bias to the transfer roller 18.

Figure 6:
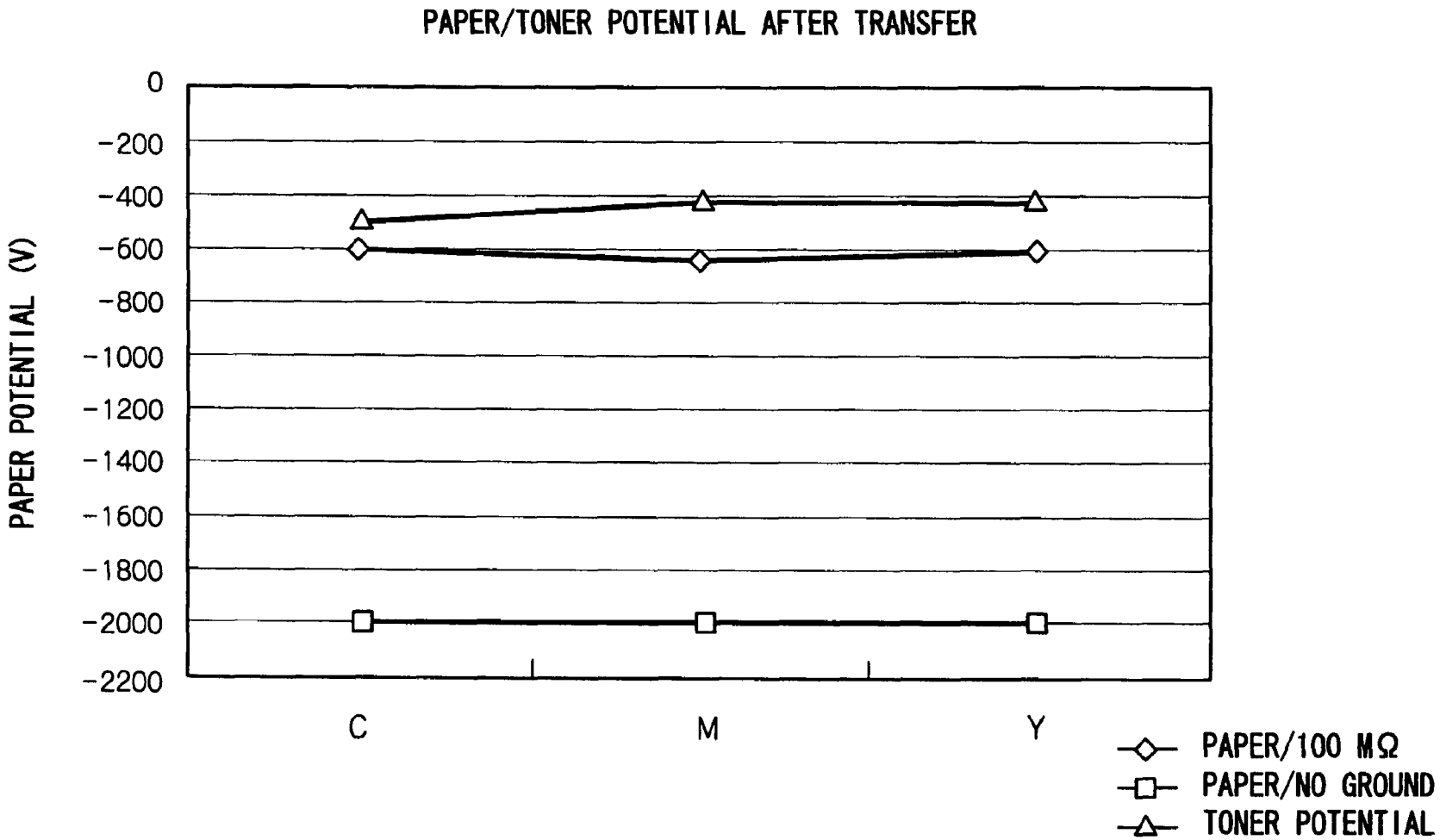
FIG. 6 is a diagram showing paper potential of the image recording apparatus pertaining to the first embodiment of the invention.

That is, as shown in FIG. 6, the potential of the paper and toner after transfer becomes about −2000 V when the guide rollers 22A and 22B are not grounded (indicated by □-□ in FIG. 6), but the electric potential can be regulated to about −600 V by connecting the guide rollers 22A and 22B to grounds via resistors 23A and 23B of about 100 MΩ (indicated by ◇-◇ in FIG. 6). Thus, image defects resulting from the potential rising too much can be prevented.

Figure 4:
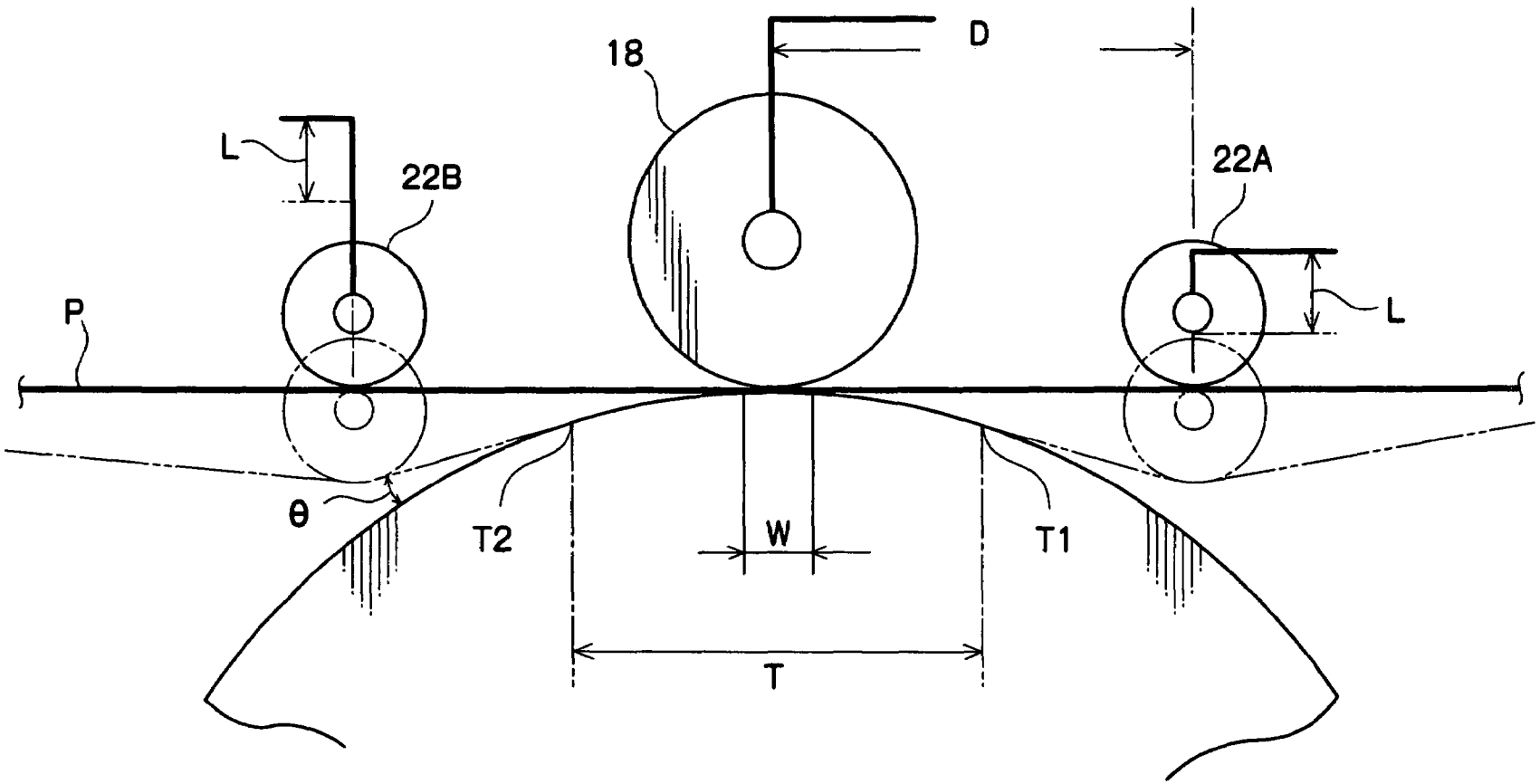
FIG. 4 is a side view showing the transfer unit of the image recording apparatus pertaining to the first embodiment of the invention.

FIG. 4 shows the transfer unit pertaining to the first embodiment of the invention.

As shown in FIG. 4, the transfer roller 18 contacts the photoconductor drum 12 and causes the continuous paper P to be pressed against and contact the photoconductor drum 12.

FIGS. 7A and 7B show the relationship between a nip width W of the transfer roller 18, positions L (the direction in which the guide rollers 22 press the continuous paper P, which is the vertical direction in the drawings) of the guide rollers 22A and 22B, and printing image quality. FIG. 7A shows the relationship between the nip width W and the position L of the guide roller 22A, and FIG. 7B shows the relationship between the nip width W and the position L of the guide roller 22B. The interaxial distance between the transfer roller 18 and the guide rollers 22A and 22B is constant at 140 mm.

As shown in FIGS. 7A and 7B, by changing the nip width W, the positions L of the guide rollers 22 at which good image quality (indicated by "A" in the same figures) can be obtained also vary, and the values differ between the guide rollers 22A and 22B.

Thus, by independently changing the positions L of the guide rollers 22A and 22B when the nip depth of the transfer roller 18 has been changed and the nip width W has been changed, good image quality can always be obtained.

Further, as shown in FIG. 4, a contact width T of the continuous paper P contacting the photoconductor drum 12 due to the guide rollers 22 is larger than the nip width W of the transfer roller 18, a position T1 at which the continuous paper P starts contacting the photoconductor drum 12 is farther upstream in the conveyance direction than the position at which the transfer roller 18 starts nipping the continuous paper P, and a position T2 at which the continuous paper P stops contacting the photoconductor drum 12 is farther downstream in the conveyance direction than the position at which the transfer roller 18 stops nipping the continuous paper P.

Moreover, by configuring the guide rollers 22A and 22B such that they are movable, the contact width T and the separation angle θ of the continuous paper P can be optimized in accordance with the environment, such as the thickness of the continuous paper P and temperature and humidity. That is, adjustments can be intentionally made, such as enlarging the contact width T when the continuous paper P is thick or narrowing the separation angle θ when humidity is high. Thus, conveyability and image quality can always be maintained in accordance with the condition.

Figure 5:
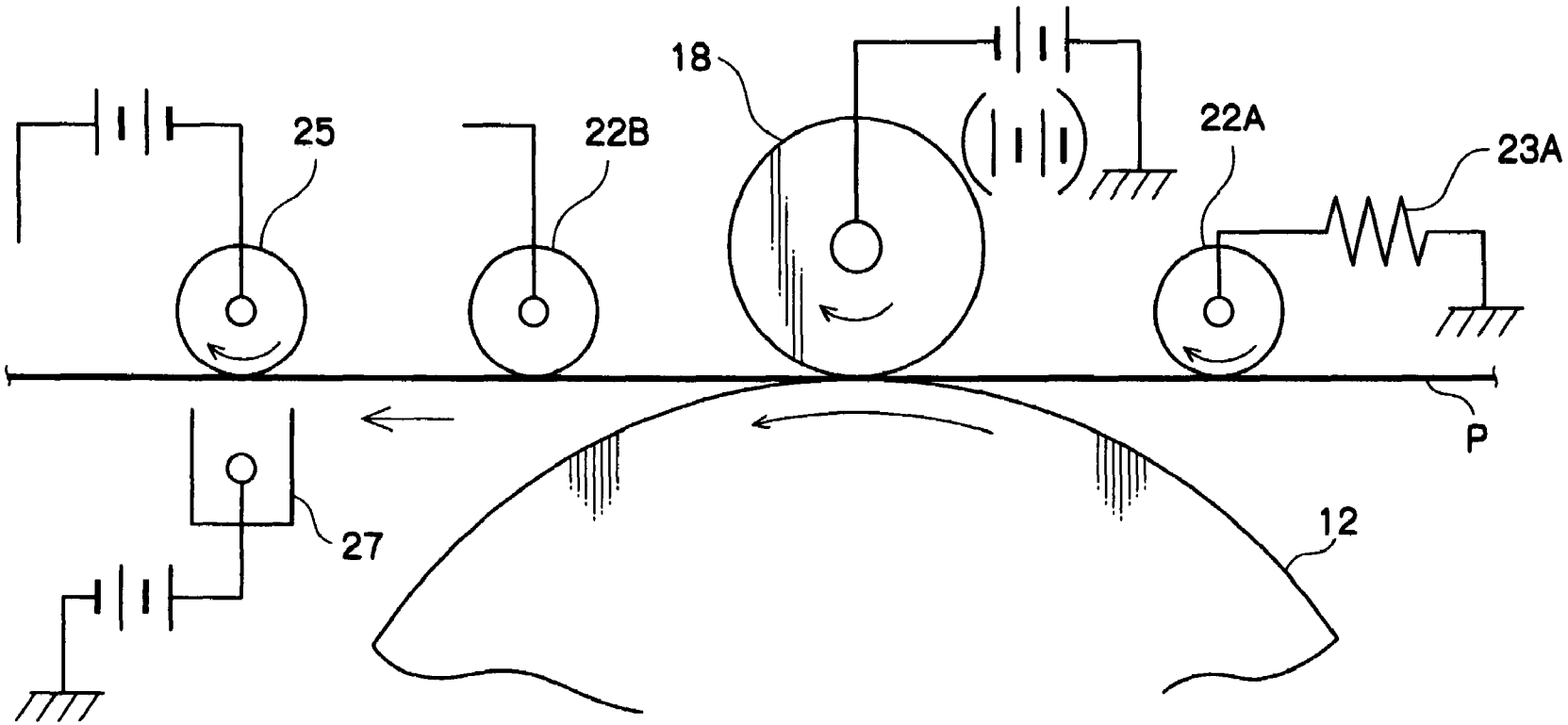
FIG. 5 is a side view showing a transfer unit of an image recording apparatus pertaining to a second embodiment of the invention.

FIG. 5 shows a transfer unit pertaining to a second embodiment of the invention.

As shown in FIG. 5, similar to the first embodiment, the guide rollers 22A and 22B are disposed upstream and downstream of the transfer roller 18 in the conveyance direction, and the conveyance path of the continuous paper P is regulated, whereby it can be ensured that the transfer roller 18 stably causes the continuous paper P to be pressed against and contact the photoconductor drum 12.

Moreover, as shown in FIG. 5, the potential of the continuous paper P and the toner image on the continuous paper P can be regulated by connecting the guide roller 22A to a ground via a resistor 23A of about 100 MΩ. In the present embodiment, the guide roller 22B is not grounded, but rather a destaticization opposing roller 25 and a paper destaticizing charger 27 are disposed at opposing positions, with the continuous paper P sandwiched therebetween, downstream of the transfer roller 18 in the conveyance direction. Thus, after the continuous paper P passes the transfer roller 18, the continuous paper P can be more effectively destaticized.

Because the present invention is configured as described above, an image recording apparatus whose structure is simple and whose quality is stable can be achieved. That is, by disposing the guide rollers 22, a stable contact width where the continuous paper P contacts the photoconductor drum 12 is ensured, and an optimum transfer region is obtained by changing the positions of the guide rollers 22. Further, by grounding the guide rollers 22, a rise in the potential of the continuous paper P can be suppressed, whereby good image quality is obtained.

In the invention with the above-described configuration, the conveyance position of the continuous paper is regulated by the guide rollers, whereby the region where the photoconductor drum and the continuous paper contact each other can be stably maintained at a predetermined size.

Further, in the image recording apparatus of the present invention, the guide rollers may be supported such that they are movable in the conveyance direction of the continuous paper and in the direction perpendicular to the surface of the continuous paper.

In the invention of this configuration, the guide rollers are configured to be movable so that the conveyance position of the continuous paper can also be varied and the region where the photoconductor drum and the continuous paper contact each other can be adjusted to an optimum region.

Further, in the image recording apparatus of the present invention, a contact width of the continuous paper contacting the photoconductor drum due to the guide rollers can be larger than a nip width of the transfer roller, the position at which the continuous paper starts contacting the photoconductor drum can be farther upstream in the conveyance direction than the position at which the transfer roller starts nipping the continuous paper, and the position at which the continuous paper stops contacting the photoconductor drum can be farther downstream in the conveyance direction than the position at which the transfer roller stops nipping the continuous paper.

In the invention of this configuration, by making the contact region resulting from the guide rollers larger than the nip width of the continuous paper resulting from the transfer roller, a stable contact region can be maintained without being effected by the nip pressure or the like of the transfer roller.

Further, in the image recording apparatus of the present invention, the positions of the guide rollers can be changed in accordance with the thickness of the continuous paper and the hygrothermal environment.

In the invention of this configuration, the size of the contact region and the separation angle of the continuous paper can be optimized in accordance with the thickness of the continuous paper and the hygrothermal environment.

Further, in the image recording apparatus of the present invention, the guide rollers may be connected to grounds.

In the invention of this configuration, the continuous paper is destaticized by grounding the guide rollers, an excessive rise in the potential of the continuous paper resulting from transfer bias application is suppressed, and image defects and the like can be prevented.

Further, in the image recording apparatus of the present invention, resistors may be disposed between the guide rollers and the grounds.

In the invention of this configuration, the potential of the continuous paper can be regulated to an appropriate potential when the continuous paper is destaticized by the grounding of the guide rollers.

Because the present invention is configured as described above, an image recording apparatus whose structure is simple and whose quality is stable can be achieved.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image recording apparatus comprising:

a plurality of conveyor rollers that convey paper;

a photoconductor drum, a toner image being formed on the photoconductor drum;

a transfer roll that transfers the toner image on the photoconductor drum onto the paper conveyed by the plurality of conveyor rollers, the paper being pressed against the photoconductor drum;

a first guide roller that is disposed at an upstream side of the transfer roller in a conveyance direction of the paper, the first guide roller being movable in a direction perpendicular to the surface of the paper; and a second guide roller that is disposed at a downstream side of the transfer roller in a conveyance direction of the paper, the second guide roller being movable in a direction perpendicular to the surface of the paper, wherein the first guide roller and the second guide roller push the paper by moving to a side of the transfer roller in a direction perpendicular to the surface of the paper at least when the toner image is transferred from the photoconductor drum to the paper.

2. The image recording apparatus of claim 1, wherein a contact width of the paper contacting the photoconductor drum due to the first guide roller and the second guide roller is larger than a nip width of the transfer roller, a position at which the paper starts contacting the photoconductor drum is farther upstream in the conveyance direction of the paper than a position at which the transfer roller starts nipping the paper, and a position at which the paper stops contacting the photoconductor drum is farther downstream in the conveyance direction of the paper than the position at which the transfer roller stops nipping the paper.

3. The image recording apparatus of claim 1, wherein the first guide roller and the second guide roller are movable in the conveyance direction of the paper, and wherein a position of at least one of the first guide roller and the second guide roller is changed in accordance with the thickness of the paper and the hygrothermal environment.

4. The image recording apparatus of claim 1, wherein at least one of the first guide roller and the second guide roller is connected to a ground.

5. The image recording apparatus of claim 1, wherein a resistor is disposed between at least one of the first guide roller and the second guide roller and the ground.

6. The image recording apparatus of claim 1, wherein the region where the photoconductor drum and the paper contact each other is maintained at a predetermined size.

7. The image recording apparatus of claim 1, further comprising:

a destaticization opposing roller; and a paper destaticizing charger, wherein the destaticization opposing roller and the paper destaticizing charger are disposed at opposing positions, with the continuous paper sandwiched therebetween, downstream of the transfer roller in the conveyance direction of the paper.

8. The image recording apparatus of claim 1, wherein the paper transferred by the plurality of conveyance roller is continuous paper.

* * * * *